US006709003B2

(12) United States Patent
Laughlin et al.

(10) Patent No.: US 6,709,003 B2
(45) Date of Patent: Mar. 23, 2004

(54) TOOL FREE SYSTEM FOR ADJUSTING THE MOUNTING LOCATION OF AN ENGAGEMENT MEMBER

(75) Inventors: James Laughlin, Burlington, VT (US); Ryan Coulter, Stowe, VT (US); Benjamin Beck, Boston, MA (US); Thomas Powers, Boston, MA (US); Glen V. Walter, Boxford, MA (US)

(73) Assignee: The Burton Corporation, Burlington, VT (US)

( * ) Notice: Subject to any disclaimer, the term of this patent is extended or adjusted under 35 U.S.C. 154(b) by 40 days.

(21) Appl. No.: 09/880,577

(22) Filed: Jun. 13, 2001

(65) Prior Publication Data

US 2002/0190503 A1 Dec. 19, 2002

Related U.S. Application Data

(63) Continuation-in-part of application No. 09/560,094, filed on Apr. 28, 2000, now Pat. No. 6,416,075.

(51) Int. Cl.[7] ..... A63C 9/00

(52) U.S. Cl. ..... 280/623; 280/14.21; 280/619; 280/14.22

(58) Field of Search ..... 280/624, 14.2, 280/600, 601, 607, 613, 617, 619, 620, 633, 634, 635, 623

(56) References Cited

U.S. PATENT DOCUMENTS

| | | | |
|---|---|---|---|
| 1,678,579 | A | 7/1928 | Vincent |
| 2,023,054 | A | 12/1935 | Mandelid |
| 2,130,693 | A | 9/1938 | Nashe et al. |
| 2,235,164 | A | 3/1941 | Pfeiffer |
| 3,044,792 | A | 7/1962 | Osborn et al. |
| 3,155,398 | A | 11/1964 | Marker |
| 3,649,039 | A | 3/1972 | Gertsch et al. |

(List continued on next page.)

FOREIGN PATENT DOCUMENTS

| | | | |
|---|---|---|---|
| EP | 0 852 958 | A1 | 7/1998 |
| FR | 2 758 468 | A1 | 7/1998 |
| GB | 2196905 | A | 11/1988 |
| JP | 09-187543 | A | 7/1997 |
| JP | 10-248990 | A | 9/1998 |

OTHER PUBLICATIONS

US 6,062,576, 5/2000, Carpenter et al. (withdrawn)
Technical Evaluation (registrability) Report in Japanese Counterpart Registration No. 3081397.
Copy of European Search Report for EP01109491, dated Aug. 13, 2001.

*Primary Examiner*—Brian L. Johnson
*Assistant Examiner*—Kelly E Campbell
(74) *Attorney, Agent, or Firm*—Wolf, Greenfield & Sacks, P.C.

(57) ABSTRACT

A system for tool free disengagement of an engagement member from a base while the base is mounted to a substrate, so that the engagement member may be repositioned, tool free, in a new mounting location. The engagement member and the base include complementary locking members, and the engagement member may be constructed so that manipulation of the engagement member releases the complementary locking members allowing relocation of the engagement member in a new mounting location. The system may be incorporated in a binding for securing a foot or a boot and in footwear.

75 Claims, 3 Drawing Sheets

U.S. PATENT DOCUMENTS

| | | | |
|---|---|---|---|
| 3,724,866 | A | 4/1973 | Kaplan |
| 3,936,063 | A | 2/1976 | Sittmann |
| 4,083,578 | A | 4/1978 | Moog et al. |
| 4,522,422 | A | 6/1985 | Jaeger |
| 4,592,734 | A | 6/1986 | Metiver |
| 4,693,199 | A | 9/1987 | Omachen et al. |
| 4,718,181 | A | 1/1988 | Olivieri |
| 4,969,655 | A | 11/1990 | Katz |
| 5,143,396 | A | 9/1992 | Shaanan et al. |
| 5,147,234 | A | 9/1992 | Brug |
| 5,362,087 | A | 11/1994 | Agid |
| 5,556,123 | A | 9/1996 | Fournier |
| 5,692,765 | A | 12/1997 | Laughlin |
| 5,758,895 | A | 6/1998 | Bumgarner |
| 5,769,446 | A | 6/1998 | Borsoi |
| 5,906,058 | A | 5/1999 | Rench et al. |
| 5,918,897 | A | 7/1999 | Hansen et al. |
| 5,927,744 | A | 7/1999 | Knapschafer |
| 6,009,638 | A | 1/2000 | Maravetz et al. |
| 6,056,300 | A | 5/2000 | Carpenter et al. |
| 6,056,312 | A | 5/2000 | Hogstedt |
| 6,113,114 | A | 9/2000 | Zemke et al. |
| 2003/0098569 | A1 | 5/2003 | Gonthier |

TOOL FREE SYSTEM FOR ADJUSTING THE MOUNTING LOCATION OF AN ENGAGEMENT MEMBER

RELATED APPLICATION

This application is a continuation-in-part of and claims the benefit under 35 U.S.C. § 120 of the filing date of U.S. patent application Ser. No. 09/560,094, now U.S. Pat. No. 6,416,075, filed Apr. 28, 2000, which is hereby incorporated by reference in its entirety.

FIELD OF THE INVENTION

The invention relates to a tool free system for adjusting the mounting location of an engagement member and, particularly, relates to a system for repositioning the mounting end of an engagement member within a base while the base is mounted to a substrate and without the assistance of external tools.

BACKGROUND OF THE INVENTION

Binding devices are employed to secure a rider to boards and other devices configured for gliding, such as snowboards, snow skis, water skis, wake boards, surf boards and the like. For purposes of this patent, "gliding implement" will refer generally to any of the foregoing boards as well as to other devices which allow a rider to traverse a surface.

Certain types of bindings, known as strap or tray bindings, employ elongated straps to mount a rider's foot or boot to a gliding implement. A strap type snowboard binding 10 is shown in FIG. 1 and includes a baseplate 12 adapted to receive a rider's boot 14 and one or more straps extending across the boot receiving area for securing the boot 14 to the binding 10. Typical are a toe strap 16 and an ankle strap 18, each of which includes a ratchet strap 20 and a boot engagement strap section 22 that are separated from each other to provide an opening for the rider to place his or her boot 14 into the binding 10. The strap portions 20 and 22 are then rejoined and tightened around the seated boot 14 to securely hold the boot 14 on the snowboard 1.

An end of each strap section 20 and 22 includes an eyelet 24 that is registrable with a mounting hole 26 extending through a sidewall of the baseplate 12. A threaded bolt is inserted through the aligned openings and then tightened with a t-nut or other fastener to secure the strap section to the binding. Because different mounting locations of a strap are better suited to a particular style of riding, and because the comfort and fit of a boot to a binding may be varied by adjustment of the strap position, strap-type snowboard bindings typically include a series of spaced mounting holes 26 in the sidewall allowing a rider to selectively change the strap mounting location. Using a screwdriver, wrench and/or other tool, the rider loosens the fastening hardware and then repositions the strap so that the eyelet 24 aligns with a different mounting hole 26. The hardware is then reassembled and tightened with the appropriate tools so that the toe and/or ankle strap extends across the rider's boot in a location suitable for the type of riding intended or for the desired comfort.

Recently, Burton Snowboards, the assignee of the present application, introduced a snowboard binding with a toe strap that was moveable from a first mounting location to a second mounting location on the binding without requiring the rider to use external tools. As shown in FIG. 2, the toe strap again included a ratchet strap section 20 and a boot engagement section (not shown). Two generally cylindrical shaped bosses 28 projected sideways from a mounting end of each section of the toe strap. The bosses 28 were engageable with a pair of opposed catches 30 (first mounting location) located in respective slots on each side of the baseplate. A second pair of opposed catches 32 (second mounting location) were located in each slot approximately twenty millimeters rearward from the first pair of catches 30.

To move the toe strap from the first mounting location to the second mounting location, the binding 10 first had to be removed from the snowboard 1 because the top surface of the snowboard 1 at the bottom 34 of the slot prevented the strap from being moved downward out of engagement with the catches 30. Once the binding 10 was removed from the snowboard 1, the top portion of the toe strap extending away from the baseplate was grabbed and pushed toward the bottom of the baseplate, moving the strap past the bottom 34 of the slot and freeing the bosses 28 from the first pair of catches 30. The strap 16 was then slid rearwardly until the bosses 28 were aligned with the second pair of catches 32. Drawing the top of the strap 16 upwardly seated the bosses 28 in the other pair of catches 32, placing the toe strap 16 in the second mounting location. To secure the binding 10 to the board with the toe strap in the new mounting location, a hold down mount, e.g., a hold down disc (not shown), was nested in a slightly smaller aperture in the baseplate floor. Screws or bolts were then passed through openings in the hold down mount and mated to threaded inserts in the snowboard 1, mounting the baseplate 12 to the snowboard 1. While this Burton arrangement did not require tools to reposition the toe strap between the first and second mounting locations on the binding, tools were necessary to first unfasten the binding from the snowboard, providing the necessary clearance for advancing the toe strap sufficiently beneath the bottom of the baseplate to release the bosses 28 from the catches 30 or 32 at the first or second mounting location and move the toe strap to the other mounting location. Thus, the prior Burton binding did not provide on-board, tool free adjustment of the toe strap mounting location.

Although the bottom 34 of the toe strap slot was open in the Burton binding shown in FIG. 2, the toe strap did not fall out of the slot because the baseplate was mounted flush to the snowboard surface. The portion of the sidewall where the ankle strap was mounted, however, was elevated well above the snowboard surface. A slotwall-type mounting arrangement was not suitable here as the ankle strap could have slipped out of the baseplate without a snowboard surface available to seal the slotwall bottom opening. Consequently, in the Burton binding configured with a tool free toe strap, the ankle strap was mounted to the outside of the baseplate sidewall with a screw and t-nut in the conventional fashion.

SUMMARY OF THE INVENTION

In one embodiment in accordance with an aspect of the invention there is provided a tool free system for adjusting a mounting location of an engagement member on a base while the base is mounted to a substrate. The engagement member is conformable to an object which is to be restrained and the base is adapted to receive at least a portion of the restrained object. The engagement member has a mounting end that is engageable with the base at a first mounting location and is arranged for tool free disengagement from the first mounting location and movement to a second mounting location while the base is attached to the substrate. The engagement member may be moveable by a user to disengage the mounting end from the first mounting location.

In another aspect of the invention, a binding for securing a foot or a boot to a gliding implement includes a base that receives the foot or boot and is attachable to the gliding implement. At least one strap that is conformable to a surface of the foot or boot is engageable on said base at a first mounting location and at a second mounting location. The at least one strap is disengageable tool free from the first mounting location and movable to said second mounting location while remaining attached to said base and while said base is attached to the gliding implement.

In another aspect of the invention, a binding for securing a foot or a boot to a gliding implement includes a base that receives the foot or boot and is attachable to the gliding implement. At least one strap that is conformable to a surface of the foot or boot as it is tightened thereagainst is mountable to the base at a first mounting location. The base and the at least one strap include complementary locking members for attaching the at least one strap to the base at the first mounting location, and one of the at least one strap and the base are biased to urge the complementary locking members into engagement while the at least one strap is in an untightened state.

In another aspect of the invention, a snowboard binding includes a baseplate with an aperture and a complementary hold down disc for mating with the aperture and securing the baseplate to the snowboard. The baseplate includes a pair of sidewalls and a heel hoop, and a highback extending from a rear portion of said baseplate. At least one strap that is conformable to a surface of the boot as it is tightened thereagainst includes a mounting end portion. At least one of said pair of sidewalls and said heel hoop defines a slot which receives the mounting end portion of the at least one strap in a first fixed mounting location. The mounting end portion of the at least one strap is releasable, tool free, from said first fixed mounting location within the slot while said baseplate is attached to the snowboard and then repositionable, tool free, in a second fixed mounting location within the slot.

In another aspect of the invention, a binding for securing a foot or a boot to a gliding implement includes a base for receiving the foot or boot that is attachable to the gliding implement, and at least one foot or boot engagement member is conformable to a surface of the foot or boot as it is tightened thereagainst. The binding also includes means for allowing tool free adjustment of said at least one foot or boot engagement member from a first mounting location to a second mounting location while the base is attached to the gliding implement and without disconnecting the strap from the base.

In another aspect of the invention, a method for tool free adjusting the mounting location of a foot or boot engagement member on a binding includes providing a binding having a base and at least one foot or boot engagement member. The binding includes first and second mounting locations for the at least one foot or boot engagement member, and is mounted to the gliding implement. The method also includes adjusting the at least one foot or boot engagement member from the first mounting location to the second mounting location without tools while the binding is mounted to the gliding implement and without disconnecting the at least one foot or boot engagement member from the base.

In another aspect of the invention, a snowboard binding includes a base, at least one binding strap, and a detent supported by the base and adapted to mount the at least one binding strap to the base in at least two mounting positions. The detent and the at least one binding strap are configured to allow the at least one binding strap to be selectively moved between the at least two strap mounting positions without tools while the base is attached to a snowboard by applying a force to a resilient member.

In another aspect of the invention, a snowboard binding includes a base having a bottom and at least one side flange supported by the bottom. The at least one side flange has a front slot that extends from a top of the at least one side flange through the bottom of the at least one side flange. A toe strap is positioned at least partially within the front slot, and at least two front strap mounting features are adapted to engage the toe strap with the base at at least two mounting positions. The at least two front strap mounting features are positioned within the front slot and adapted to allow the toe strap to be moved between the at least two mounting positions without tools while the base is attached to a snowboard. The snowboard binding may also include a rear slot that extends from a top of the side flange toward a bottom of the side flange and an ankle strap positioned at least partially within the rear slot. At least two rear strap mounting features are positioned within the rear slot and adapted to engage the ankle strap at at least two rear mounting positions. The at least two rear strap mounting features are adapted to allow the ankle strap to be moved between the at least two rear mounting positions without tools while the base is attached to a snowboard.

Another illustrative embodiment of the invention is directed to a snowboard binding including a base, at least one binding strap having a resilient end, and at least two strap mounting features supported by the base. The strap mounting features are adapted to mount the at least one binding strap to the base in at least two mounting locations. The strap mounting features and the binding strap are configured to allow the at least one binding strap to be selectively moved between the at least two strap mounting locations. The resilient end tends to retain the strap end in one of the mounting locations and is deformable to allow the strap to be selectively disengaged from the one of the mounting locations and moved to another of the mounting locations.

Another illustrative embodiment of the invention is directed to a snowboard binding including a base, at least one binding strap, and at least two strap mounting features supported by the base. The strap mounting features are adapted to mount the at least one binding strap to the base in at least two mounting locations. The strap mounting features and the binding strap are configured to allow the at least one binding strap to be selectively moved between the at least two strap mounting locations. A resilient shelf attached to the base tends to retain the binding strap in one of the mounting locations and is deformable to allow the strap to be selectively disengaged from the one of the mounting locations and moved to another of the mounting locations.

BRIEF DESCRIPTION OF THE DRAWINGS

Aspects of the invention will be appreciated more fully with reference to the following detailed description of illustrative embodiments, when taken in conjunction with the accompanying drawings, wherein like reference characters denote like features, in which.

DETAILED DESCRIPTION

Aspects of the invention are directed to an arrangement for adjusting the mounting location of an engagement member on a base, while the base is still attached to a substrate and without the need to apply external tools, e.g., a screwdriver, coin, wrench, etc. The system has particular application to a binding having one or more engagement members, such as a strap, for securing an object, such as a boot or foot, to a gliding implement or other substrate, and to a sport shoe or a boot including one or more engagement members for securing footwear components to improve performance properties such as heel hold down, for example, when the engagement member extends across the tongue or vamp of the sport shoe or boot. In certain embodiments, the mounting arrangement is completely internal to the base and cannot be, and need not be, directly accessed while the base is mounted to a substrate. In the latter arrangements, in particular, one of the engagement members or the base may be manipulated to disengage the engagement member from a mounting location.

For ease of understanding, and without limiting the scope of the invention, the inventive arrangement for tool free adjustment of the mounting location of an engagement member to which this patent is addressed is disclosed below particularly in connection with a snowboard binding that is used to secure a rider's boot to a snowboard. It should be appreciated, however, that the inventive engagement member repositioning system may be incorporated in a foot or boot binding device that may be mounted to substrates that are not designed specifically for gliding or other sports applications, and in a binding device that is employed to restrain objects other than a foot or boot.

Figure 1:
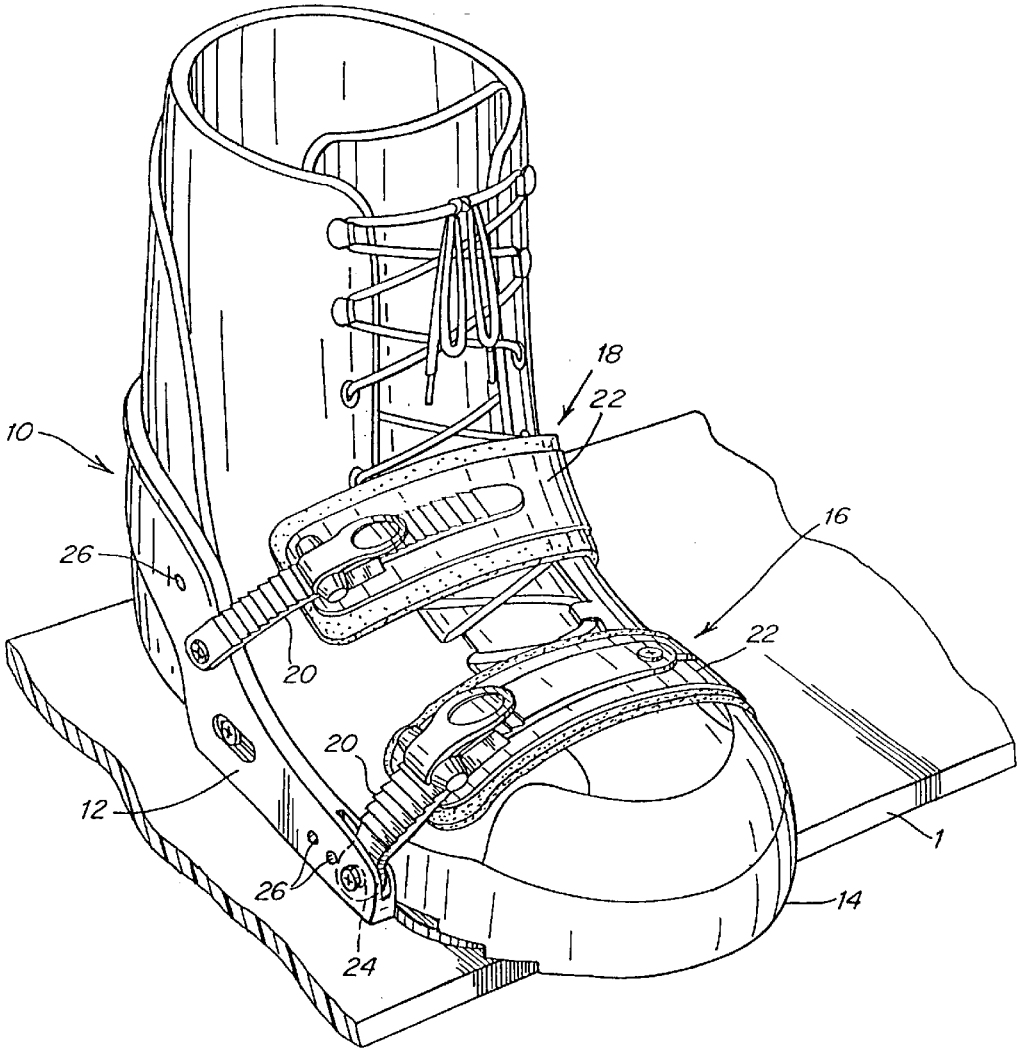
Fig. 1 PRIOR ART
FIG. 1 is a perspective view of a prior art strap type binding with screw and t-nut engagement of the straps to the binding baseplate.
Figure 2:
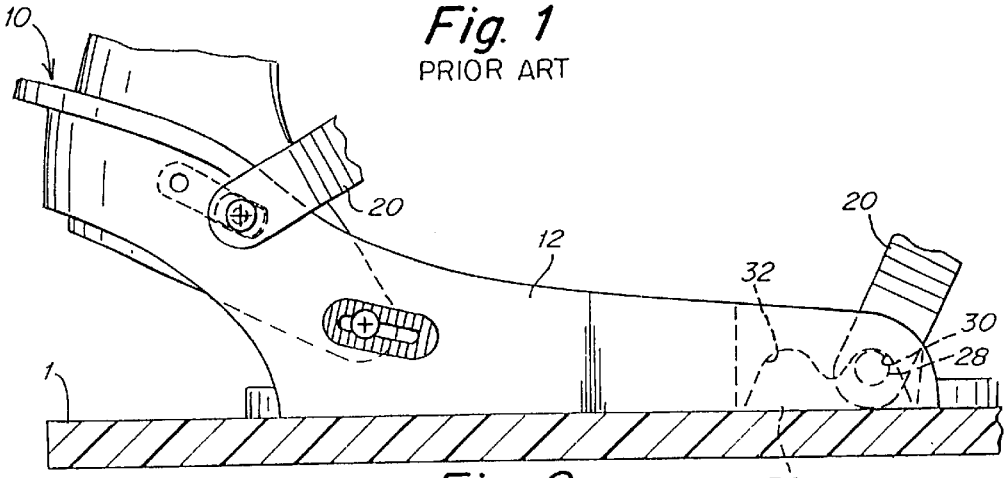
Fig. 2 PRIOR ART
FIG. 2 is a sectional illustration of a prior art binding with a toe strap mounted for tool free adjustment only when the binding has been removed from the board and with an ankle strap mounted in the same manner as the binding of FIG. 1.
Figure 3:
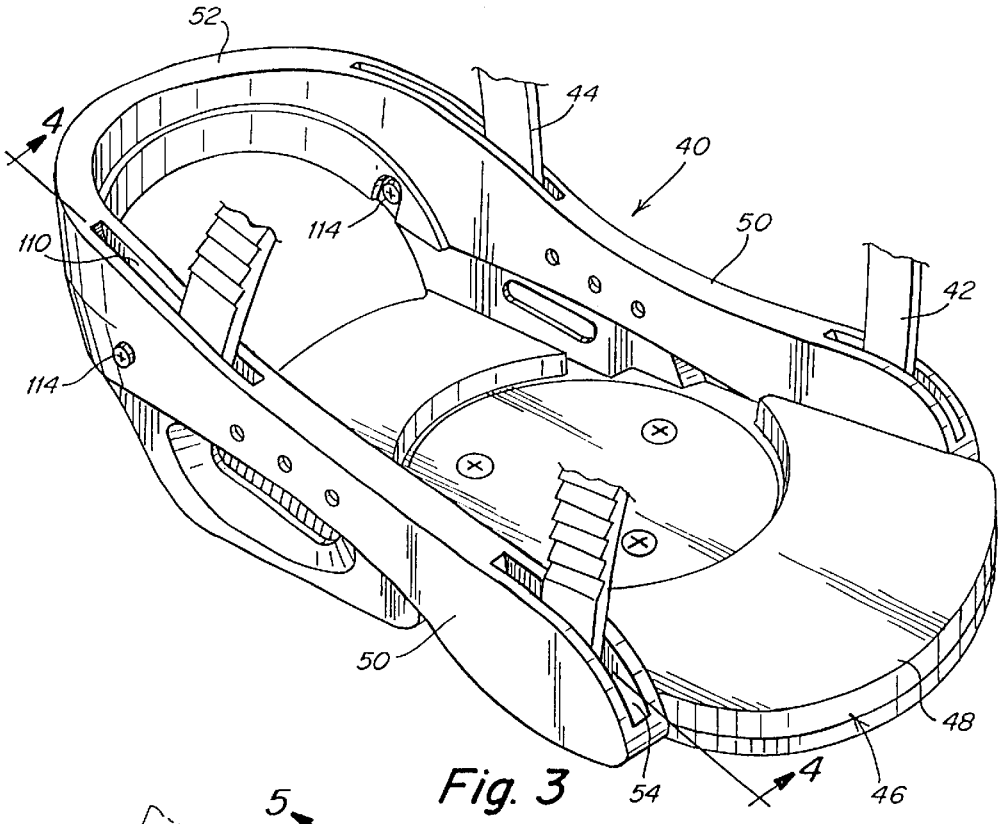
FIG. 3 is a perspective view of a binding in an embodiment in accordance with an aspect of the invention.

The embodiment illustrated in FIG. 3 is a snowboard binding 40 arranged with a toe strap 42 and an ankle strap 44 for securing a rider's boot to a snowboard. A mounting location on the baseplate 46 for each of the toe strap 42 and the ankle strap 44 may be changed by the rider without using tools (i.e., "tool free") and while the binding is mounted to the snowboard (i.e., "on board"), allowing the rider to select an appropriate setting suited to a particular style of riding or to a desired comfort or fit of the boot in the binding. Although the illustrated binding has two straps each of which is arranged for tool free, on board adjustment of the strap mounting location, the invention is not limited to a dual strap arrangement. Rather, the invention encompasses a binding having any number of straps that are constructed and arranged to allow relocation of the strap mounting without requiring the use of external tools and without having to remove the binding from the snowboard to free the strap from the mounting location. Thus, a binding with only a toe strap or an ankle strap, or a binding with a toe strap, an ankle strap and a shin strap are contemplated as are other binding constructions that employ different strap arrangements not expressly mentioned here. Further, the invention contemplates a binding having two or more straps where one or more, but not all, of the straps are arranged for tool free, on board adjustment. That is, some of the straps may require use of a screwdriver and/or a wrench, or other tool, to loosen and then to retighten fastening hardware to permit adjustment of the mounting location of the strap along the binding, but that arrangement is still within the scope of aspects of the invention so long as at least one strap is configured for tool free, on-board adjustment. Alternatively, the binding may include strapless engagement members in addition to one or more straps that are configured for tool free, on board mounting location adjustment.

The snowboard binding shown in FIG. 3 includes a baseplate 46 adapted to receive a snowboard boot, the base 46 having a floor 48, a pair of opposed sidewalls 50 and a heel hoop 52. A slot 54 extending within the sidewall 50 near the front or toe end of the binding 40 is sized to receive a mounting end of a strap 42 that will secure a front portion of a boot 14 to the snowboard 1. By mounting the strap within the slot 54 rather than to the outside of the baseplate sidewall 50, as in many conventional strap binding designs, the straps 42 and 44 are brought closer to a rider's boot. Such intimate foot wrap helps to eliminate a lag in response time by the board when the rider leans her boot into the binding straps 42 and 44. The slot 54 includes two or more locking members 56, illustrated in FIG. 4, which may be in the form of catches or recesses as shown, that are adapted to mate with a complementary locking member 58 on the strap. The strap carried locking member 58 in the illustrated embodiment is a boss or rod, that extends from one or both sides of the strap 42, and which is captured by the locking member 56 in the slot 54, e.g., the catch or a pair of opposed catches in the slot 54. The length of the locking member 58 combined with the thickness of the strap portion 42 from which it projects is larger than the opening at the top of the slot 54, preventing the strap 42 from pulling out of the baseplate 46. In the illustrated embodiment, the mounting end of the strap 42 is just slightly thinner than the slot 54 opening so that the added thickness of the projecting locking member 58 is adequate to retain the mounting strap within the slot 54.

The locking member 58 carried by the strap 42 may be molded integral with the strap or may be a separate component that is attached to the strap. In one embodiment, the mounting end of the strap 42 includes an opening into which a barrel shaped insert is snap fitted, with the ends of the barrel projecting outwardly from both sides of the strap 42. Ridges running around the margins of the barrel insert are wider than the opening through the strap preventing the insert from falling out. The reduced diameter intermediate section extending between the annular ridges is slightly smaller than the opening in the strap 42 in which it lies, allowing pivoting of the strap 42 relative to the baseplate 46.

The locking member 58 carried by the strap may be formed of the same material as the strap or of a different material, with each of plastic, rubber, other elastomers and metal being suitable. The locking member 58 may be cylindrically shaped although other shapes are contemplated and the invention is not limited to the illustrated locking member 58 as would be understood by one of skill in the art. For example, the strap 42 may carry two or more locking members 58.

The two or more locking members 56 for restraining the strap locking member 58 may have any shape that is compatible with the locking member 58 carried by the strap, such as a hollow half cylinder when the strap carried locking member 58 is a cylindrical shaped boss. The locking members 58 may be formed in the sidewall 50, such as by molding, or may be contained in a separate structure that is fitted to the sidewall 50. The locking members 58 may be arranged on only one side of a wall of the slot 54 or respective ones of opposed pairs of locking members 58 may be provided on each side of the slot 54. Various other arrangements within the sidewall slot 54 for capturing a radially extending locking member on the strap, or other mateable locking member 58 carried by the strap, are envisioned. Without limiting the arrangements for releasably securing the strap carried locking member 58, it also is proposed to arrange the slotwall locking member 56 for frictional engagement of the rod, boss, opening or other locking member, such as by using opposed ribs extending along the slotwall and which may be tapered inwardly towards the opening at the top of the slot 54 so that the locking member 58 is likely to become more tightly wedged or otherwise engaged as it is drawn upwardly in the slot 54.

Also contemplated is a locking shelf projecting from one or both sides of the mounting portion of the strap that cooperates with a compatible shelf provided along one or both sides of the sidewall defining the slot 54. The shelf on the strap may be smaller than the shelf within the slot wall to allow for various mounting locations of the strap. The shelf provided in the slotwall may be continuous or may include two or more spaced shelves. Other cooperative locking member arrangements may be implemented as would be apparent to one of skill in the art. As should be appreciated by the ordinary practitioner, the location of the complementary locking members may be reversed. Referring to the embodiment illustrated, for example, two or more bosses could be presented along a side of the slotwall, with a catch extending outwardly from a side of the mounting end of the strap.

The complementary strap locking member 58 and slotwall carried locking member 56 may be configured with a junction to allow pivoting of the strap relative to the baseplate 46, so that the strap can rotate back and forth in response to forces induced on the strap as the rider flexes and turns her boot into the main body of the strap, as occurs frequently during a run down a slope or in a half pipe. In the embodiment shown, the locking member 58 has a round profile established by its cylindrical shape that is pivotable about the curved surface of the locking member 56 in the sidewall slot 54. Other configurations of mateable locking members that allow relative pivoting while engaged also are contemplated as would be appreciated by those of skill in the art.

The mounting end of the strap 42 may be formed as a living hinge 60; that is, the bottom section of the strap 42 will temporarily compress or collapse, without permanently deforming, under the influence of an axial force along the strap in the direction of the mounting end, such as occurs when a rider grasps the strap and presses it against the baseplate 46 or snowboard 1. Urging an end of the strap against the bearing snowboard surface 62 in the case of the toe strap 42, or a bearing ledge 112 in the case of the ankle strap 44 described in more detail below, draws the strap carried locking member 58 away from the complementary locking member 56 in the baseplate sidewall 50. With the strap mounted locking member 58 in the retracted position and the living hinge 60 still in a compressed mode, the strap 42 or 44 may be moved, such as by sliding, until the locking member 58 is repositioned relative to another mateable locking member 56 in the slot 54. Upon release of the strap 42 or 44 by the rider, the living hinge 60 will revert to its prior expanded shape, securing the locking member 58 to its counterpart so that the strap is positioned in a new mounting location.

As shown, the living hinge 60 includes a thin end wall separated from a more substantial portion of the strap 42 by an opening or relief. Although a complete through opening is illustrated, a living hinge affect also may be provided by a partially recessed region at the end of the strap. Alternatively, the living hinge 60 may be provided by forming indentations or grooves in the surface of the mounting end of the strap, such as accordion or corrugated type impressions. In other embodiments, a more compressive or springy material may be included at some portion of the end of the strap, such as in all or at least a portion of the mounting region of the strap, e.g., between the locking member 58 and the mounting end of the strap, to cause the strap to collapse as an axial load is applied along the strap and against a bearing surface. Reference to the mounting end of the strap refers to any portion of the strap that interfaces with the baseplate 46 or other bearing surface, and is not limited to the portion of the strap between the locking member 58 and the very tip of the strap. The form of the living hinge 60 is not limited by the invention and will include other constructions in addition to those described here as would be apparent to those of skill in the art. Further, the living hinge affect could be constructed in the slotwall rather than in the strap so that selective compression of a portion of the slotwall would retract the slotwall mounted locking member 56 disengaging it from its mate on the strap. Once the strap is repositioned with its locking member 58 above a desired slotwall locking member, the baseplate section may be released allowing the slotwall locking member 56 to engage the strap locking member 58 in a new mounting location.

The base of the strap 42 may be rounded or curved, or otherwise configured to focus the compressive force on the living hinge region. Further, the strap base may be wider than the body of the strap to reduce the load required to actuate the hinge 60. A rounded end may facilitate pivoting of the strap relative to the bearing surface, whether the bearing surface is the snowboard 1 as in the case of the toe strap illustrated in FIG. 4, or the bearing floor 112 as in the case of the ankle strap shown in FIG. 4. Alternatively, the bearing surface may be provided with a recess or indentation that provides clearance for the mounting end to freely pivot. A particular shape of the mounting end of the strap is not essential for tool free, on board strap mounting location adjustment and a squared off end as well as other configurations also are envisioned.

Figure 4:
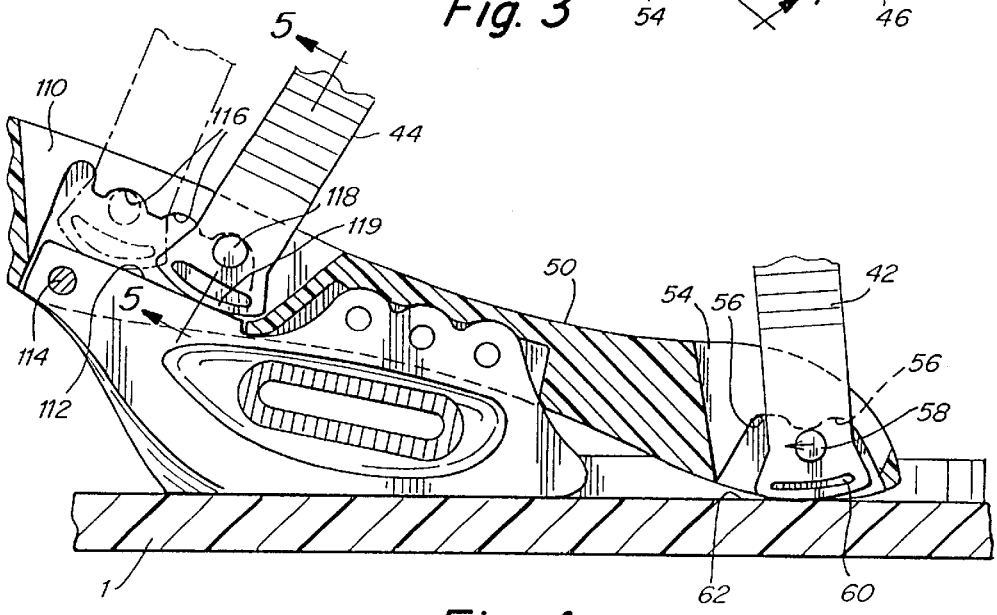
FIG. 4 is a sectional view taken along line 4—4 of FIG. 3.

The bottom of the sidewall slot 54 for mounting the toe strap 42 may remain open, as illustrated in FIG. 4, so that the mounting end of the strap will lie flush with, or be slightly compressed against, the snowboard surface 62 when the baseplate 46 is mounted to the snowboard 1. However, the strap 42 could be shortened so that the mounting end does not contact the bearing surface, yet the strap 42 could be moved between mounting locations and the binding would still ably secure a boot when the strap 42 is tightened down regardless of the strap mounting location. For example, the slot 54 may be tapered so that a top end of the slot 54 is more narrow than a bottom end. This tapering would allow the strap to move freely when moved toward the bottom of the slot 54, but have a tight interference fit with the slot 54 sidewalls when fully engaged. Unwanted disengagement may also be prevented by positioning a manually activated gate or other obstruction in the slot 54, such as a flexible wall that may be moved aside or bent over by a rider moving the strap from one mounting location to another, to prevent unintentional movement of the strap. In another embodiment, the slot 54 may include a single elongated recess, e.g., in the form of a channel, along which the strap can be positioned. Once the strap is positioned at a desired location in the slot 54, a plug or plugs can be inserted into the slot 54 to prevent movement of the strap to another mounting location. The strap may be moved in the slot 54 by removing the plug(s), moving the strap to another location, and replacing the plug(s). The plug(s) may be inserted downwardly into the slot 54, or through a hole in the sidewall 50 perpendicular to the slot 54. However, by arranging the strap end so that it is in constant contact with the bearing surface, slop or jiggling of the strap may be avoided which might otherwise adversely affect the feel or performance of the binding and might detract from the appearance of the binding when the straps are not fastened down about a rider's boots. Alternatively, the bottom of the slot for mounting the toe strap 42 could be closed or otherwise include its own bearing surface in an arrangement comparable to the bearing surface construction employed in the sidewall slot for the ankle strap 44 discussed below.

Figure 5:
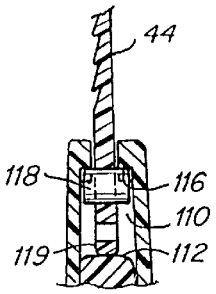
FIG. 5 is a sectional view taken along line 5—5 of FIG. 4.
Figure 6:
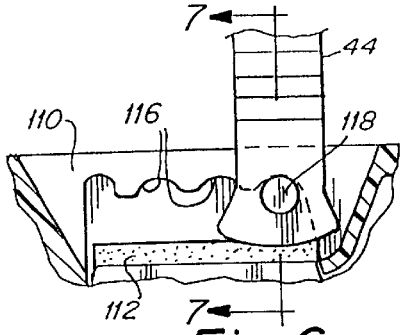
FIG. 6 is a sectional view of another embodiment in accordance with an aspect of the invention.
Figure 7:
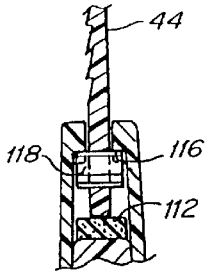
FIG. 7 is a sectional view taken along line 7—7 of FIG. 6.

As shown in FIGS. 4 and 5, the sidewall slot 110 for mounting the ankle strap 44 is elevated significantly from the surface of the snowboard 1 making it impractical to use the top of the snowboard 1 as the bearing surface against which the strap end may be urged to actuate the living hinge 119. Instead, the sidewall slot 110 includes a floor or rail 112, or other arrangement, which acts as the bearing surface. To provide direct access to the slot 110 for insertion of the strap 44, the sidewall may be formed of separate pieces which are united by releasable fasteners 114, or other mechanisms, such as bonding or welding, after the strap end is placed in a desired position. When assembled, the separate sidewall sections may combine to form the floor 112 against which the bottom of the strap end is seated. Alternately, the sidewall 50 may have a window formed in the sidewall 50 that exposes at least a portion of the slot 110 through which the strap 44 may be engaged with the binding, or the slot 110 may be formed to extend through the bottom of the elevated portion of the sidewall 50, e.g., so that the strap 44 may be inserted through the bottom of the slot 110. If the slot 110 is formed through the bottom of the sidewall 50, the bottom of the slot 110 may be closed by a door or other member, e.g., a member that is engaged with the sidewall 50 by an interference fit in the slot 54, fasteners, etc. to form the floor 112. The sidewall sections also may form two or more catches or other locking members 116 that cooperate with the locking member 118 on the strap 44 to fix the strap in multiple mounting locations. The bearing surface may be formed of a stiff material to cause compression of the living hinge 119 as the strap is urged against the bearing surface. Alternately, the floor 112 (bearing surface) may include a resilient and/or compressible material as illustrated in FIGS. 6 and 7. In this embodiment, the floor 112 may compress when the strap end is forced against it, allowing the strap 44 to travel far enough in the direction of the bearing floor 112 to disengage the strap carried locking member 118 from the slotwall locking member 116. Where the floor 112 is resilient, the strap 44 may not include a living hinge 119 or other resilient member and instead the bearing surface may urge the complementary locking members together.

Figure 8:
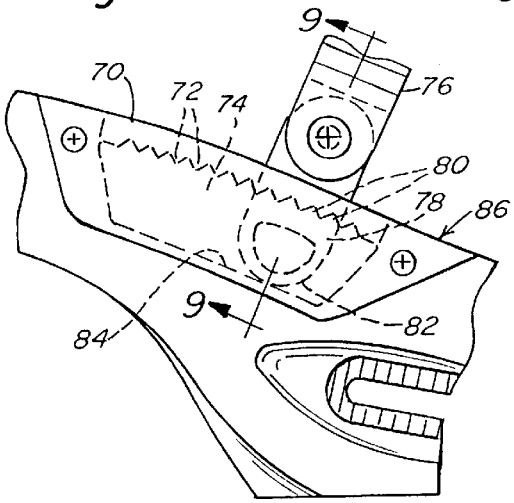
FIG. 8 is a fragmentary side view of another embodiment in accordance with an aspect of the invention.
Figure 9:
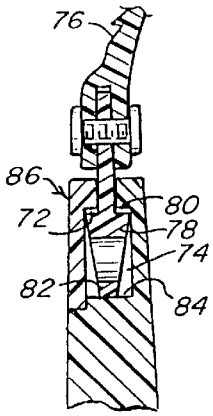
FIG. 9 is a sectional view taken along line 9—9 of FIG. 8.

Other arrangements of tool free, on board adjustment of the mounting location of a binding strap are illustrated in FIGS. 8–13. FIGS. 8 and 9 show an embodiment in which the sidewall includes a mount 70 with two parallel columns of teeth 72 within a sidewall slot 74 and further includes a central opening through which a portion of a strap 76 extends. A lower part 78 of the strap is provided with two parallel racks of teeth 80 that are engageable with a segment of the columns of teeth 72 in the slotwall. The strap 76 is formed at its mounting end with a living hinge 82 that resiliently biases against the bearing surface 84, urging the racks of teeth 80 into complementary locking with an aligned section of teeth 72 on the mount 70. Pressing the strap 76 against the bearing surface 84 compresses the living hinge 82 so that the racks of teeth 80 are retracted from their mates in the mount 70 and, once the opposing teeth are separate, the strap 76 may be slid in either direction until a new mounting location is selected. Upon release of the strap 76, the living hinge 82 springs open, uniting the strap carried teeth 80 with a different segment of counterpart teeth 72 on the mount 70, securing the strap 76 in the new mounting location. The mount 70 may be molded integral with or fitted to the wall defining the slot 74, or a separate component 86, such as a molded plastic or metal formed insert, may be fixed to an opening in the baseplate sidewall 50 as illustrated in FIG. 8. Other arrangements for implementing the toothed mount 70 are contemplated as should be apparent to one of skill in the art.

Figure 10:
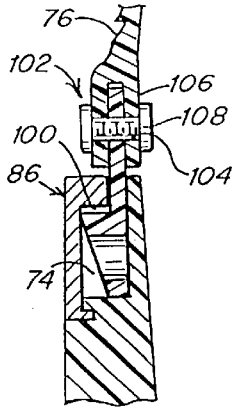
FIG. 10 is a sectional view of a different embodiment of complementary teeth type locking members.

Although the complementary locking members portrayed in FIGS. 8–9 employ pairs of teeth, a single array of teeth 100 may be employed on the mount and on the rack as shown in FIG. 10. While the teeth are arranged linearly in the illustrated embodiments, non-linear patterns also may be used as would be apparent to one of skill in the art. Although pointed angular teeth have been drawn, other interlocking shapes and arrangements are contemplated and the particular interlocks illustrated, in this case teeth, should not be understood to limit the scope of the invention. The mounting end of the strap including the teeth or other locking configuration may be articulated 102 to the body of the strap to ensure a range of motion of the strap body in response to movements of the boot by the rider. In the FIG. 10 embodiment, the mounting end of the strap includes an eyelet 104 which is registered with a clevis type junction 106 in the strap body, and a bolt and nut, rivet or other fastener system 108 is applied to join the two sections together in articulated fashion.

Figure 11:
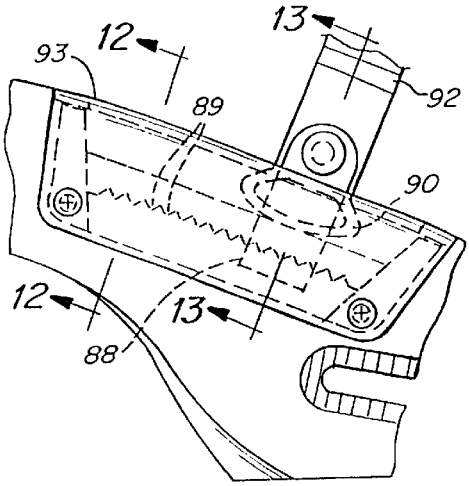
FIG. 11 is a fragmentary side view of another embodiment in accordance with an aspect of the invention.
Figure 12:
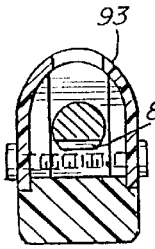
FIG. 12 is a sectional view along line 12—12 of FIG. 11.
Figure 13:
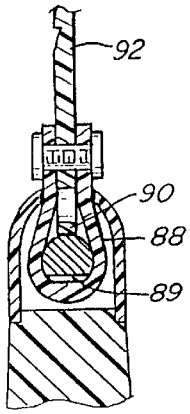
FIG. 13 is a sectional view along line 13—13 of FIG. 11.

In FIGS. 11–13, the rack of teeth on the strap is replaced by a boot 88 formed, for example, from a rubber sheet that grabs the locking teeth 89 in the sidewall slot, preventing unintentional displacement of the strap 92 from the mounting location. A resilient member 90, such as a living hinge, is connected to the strap 92 and seated against the mount 93 and urges the strap in a direction away from the mount 93. A lower section of the strap 92, positioned below the mount, includes the boot 88 although other engagement members could be employed. In the expanded or natural configuration of the biasing member 90, the boot 88 grabs the teeth 89 securing the strap 92 in a particular mounting location.

Movement of the strap 92 towards the baseplate with sufficient force will overcome the bias of the resilient member 90, separating the boot 88 and teeth 89 a sufficient distance so that the strap 92 may be moved until located in a new mounting location. Release of the strap 92 by the rider removes the load on the member 90 which then unfurls to its natural uncompressed shape, drawing the boot 88 again into engagement with the mount carried teeth 89. In the embodiment illustrated in FIGS. 11–13, the teeth 89 are supported by a mount or fitting 93 that is inserted into the slot and then fastened to the sidewall with appropriate hardware or by welding, bonding or other techniques familiar to one of skill in the art.

In the embodiments described above, the strap(s) may be a single continuous member that extends from one side of the baseplate 46 to the other or may consist of two or more separate sections that combine to span the baseplate 46. Where two or more strap sections are joined together to secure a rider's foot within the binding 40 and which are then separated to free the boot from the binding 40, one of the strap sections may be a ratchet strap having a surface portion arranged with teeth or serrations while the other strap section may be a boot engagement strap, typically longer than the ratchet strap and including a body portion that contacts the boot and which may be padded or otherwise specially configured for relieving and/or distributing pressure on sensitive areas of the foot. The ratchet strap may include a rounded narrower tip to facilitate introduction into a buckle carried on the boot engagement strap, such as a ratchet tongue. The boot engagement strap may include a fastener for releasably securing the ratchet strap, such as a buckle having a pawl for engaging the toothed surface. Advancing the ratchet strap through the buckle incrementally tightens the strap sections around the rider's boot, while the pawl prevents unintended loosening of the united strap components. The buckle may include a lever to help drive the toothed strap through the pawl. A ratchet buckle that is particularly suited for implementation with the strap used in aspects of the invention is a Slap Ratchet® buckle provided in various Burton Snowboards binding models and which is described in U.S. Pat. No. 5,745,959, which is assigned to Burton Snowboards, the owner of the present application. Other buckle configurations and other fastening arrangements for releasably joining two binding strap sections also are contemplated as would be apparent to one of skill in the art. The mounting location of the boot engagement strap, like the ratchet strap, may be arranged for tool free repositioning while the binding is secured to the board, with the mounting end of the boot engagement strap and the corresponding slotwall having a comparable construction to the ratchet strap and slotwall discussed within this specification.

The length of a strap or of individual strap sections may be adjustable; for example, a strap section may consist of a first member that is telescopically mounted to a second member and may include hardware or other fastening mechanism(s) to fix the two members at a desired overall strap section length. The arrangement of the body of the strap for securing a rider's boot is not limited by the present invention. Thus, adjustable length straps that are not configured telescopically also are within the inventive arrangement as are unvarying, single length straps. The body of the strap may include padding or cushioning to distribute pressure applied by the strap. Relief also may be provided by one or more recesses or openings in the strap body that direct forces away from particularly sensitive areas of the foot against which the strap is drawn. For example, where the strap is an ankle strap, a central portion of the body may have a reduced thickness, be formed of a compressible material, or may include one or more slotted sections to reduce rider discomfort. At least a body portion of the strap is conformable to a portion of the boot surface as the strap is tightened down. The strap, or specific strap sections, may be bendable into a substantially U-shape or other configuration that tracks the contours of the rider's boot about which it is tightened. Upon release of the strap or disengagement of the strap sections, the strap may spring partially or fully open to provide a path for removal of the boot from the binding. The strap sections may be stiffer at the mounting end and more flexible towards the opposite end to encourage conformability to the boot surface as the strap is tightened down. Suitable strap forming materials include molded, extruded or cast plastics, natural or synthetic fabrics, metal strips, and a combination of any of the above materials.

The snowboard binding illustrated includes a baseplate having a floor, sidewalls and a heel hoop. Plateless binding bases also are contemplated, which eliminate the floor so that a rider's boot seats directly on the snowboard surface. Also contemplated is an arrangement where the straps are mounted directly to the snowboard, such as in slots provided in the snowboard surface. The binding may include a highback that coacts with a heel hoop for providing heelside support and heel edge control. A forward lean adjuster may also be provided to set the highback at a preselected forward lean angle relative to the board. A hold-down disc may be used to secure the baseplate to the snowboard in any one of numerous stance angles. Various other features may be implemented to enhance riding performance. Although the binding described here is constructed to secure a snowboard rider's boot, a binding incorporating the inventive tool free system for adjusting the mounting location of an engagement member may be configured to restrain other objects as well, with the identity of the element contained by the binding not being an essential component of the invention.

The arrangement for mounting a strap for tool free adjustment also may be employed in a sports shoe or boot, particularly a hybrid boot or soft boot compatible with a step-in snowboard binding. Considerable lifting forces are generated at the heel of a snowboarder during riding. To maximize rider control, it is desirable to prevent the rider's foot, particularly the heel, from lifting off the bottom of the boot. In the "tray" type binding discussed earlier, the ankle strap can be tightened down over the boot to prevent heel lift. However, with a strapless soft boot step-in binding, there is no boot engagement member on the binding for limiting heel lift. Although the laces of the snowboard boot are available to resist lifting forces, the laces alone are often not sufficient to provide desired restraint. Consequently, many soft boots adapted for use with a step-in binding employ an ankle strap in addition to a lacing system. The ankle strap, similar to the ankle strap described above in connection with a snowboard binding, includes a ratchet strap and a boot engagement strap provided with a ratchet buckle. Each of the two strap components has a fixed end that is attached to one side of the boot, with the respective free ends being joined together.

The two strap components may be arranged on the boot so that the ankle strap may be relocated among different mounting locations about the front of the boot without the use of tools. A mount for each ankle strap section would include a base or a pedestal that is adhered, stitched or otherwise secured to the boot. Within each base would be a slotwall or equivalent feature including two or more locking members that are mateable with a locking member at a mounting end of either the ratchet strap or boot engagement member. A living hinge construction may be provided at the mounting end of the strap or, alternatively, a floor of the slotwall may be compressible and/or resilient, as discussed above in connection with a binding, such that urging of a strap section towards the floor of the slotwall causes the locking member to retract from the slotwall locking member, freeing the strap for relocation into another mounting location. The various permutations of locking members, strap mounting ends, and slotwalls disclosed above in connection with the binding embodiments apply here as well.

A representative method of adjusting the mounting location of an engagement member within a base will now be described in connection with a snowboard binding. However, the same approach will apply to a binding used on other gliding implements, to a binding for securing an object other than a boot or foot, and to a base and engagement member that is not incorporated into a binding type device. A binding is provided including a baseplate having a sidewall with a pair of toe strap slots and ankle strap slots and ratchet tongue sections received in one of each of the toe strap and ankle strap slots and boot engagement sections with buckles received in the other of each of the toe strap and ankle strap slots. The binding is mounted to a board by threading screws through apertures in a hold down disc into insert fasteners in the board. The toe straps and ankle straps are provided in either a first mounting location or a second mounting location, and the two straps need not be provided in the same mounting location (i.e., the toe strap could be positioned in the first location while the ankle strap is arranged in the second location). To change the mounting location of either strap, a rider grasps a portion of one of the strap sections, for example, the ratchet tongue extending outwardly from the baseplate, and pushes it into the baseplate so that the mounting end of the strap collapses and draws the locking boss out of the catch where it previously had been engaged. With the mounting end still collapsed, the strap is moved by the rider to the second mounting location. When the rider releases hold of the ratchet tongue, the collapsed mounting end reverts to its normal shape urging the locking boss into engagement with the locking catch at the second mounting location. The rider then proceeds in a similar fashion with the boot engagement strap associated with the just adjusted ratchet tongue. If desired, the other strap sections may be repositioned as well.

Having described several embodiments of the invention in detail, various modifications and improvements will readily occur to those skilled in the art. Such modifications and improvements are intended to be within the spirit and scope of the invention. For example, one or both sides of a slotwall may include a series of spaced holes that are mateable with a spring mounted ball or other interlock supported in a mounting end of a strap section. Depressing the ball allows the strap to disengage from the slotwall, and the strap may then be relocated so that the ball pops into an opening at another mounting location. Thus, the binding may include any type of detent that allows a strap to be moved from one mounting location to another by the tool-free application of a force on one or more resilient members, such as a living hinge on the strap mounting end. Accordingly, the foregoing description is by way of example only and is not intended as limiting. The invention is limited only as defined by the following claims and their equivalents.

What is claimed is:

1. A binding for securing a foot or a boot a gilding implement, comprising:

a base for receiving the foot or boot, said base being attachable to the gliding implement;

at least one strap that is conformable to a surface of the foot or boot as it is tightened thereagainst;

said at least one strap being attachable on said base at a first mounting location and at a second mounting location, said at least one strap being disengageable tool free from said first mounting location and movable to said second mounting location while said base is attached to the gilding implement, wherein said at least one strap cannot be removed from said base while said base is attached to said gliding implement; and a sidewall having a slot for receiving said at least one strap in said first mounting location and said second mounting location, said slot including a bottom that is open, said base being flush mountable to the gliding implement so that said at least one strap is seatable through said open bottom of said slot against a surface of the gliding implement.

2. The binding of claim 1, wherein said at least one strap includes a first section and a second section, said first and second sections being separable to allow insertion and removal of the foot or boot and being releasably engageable to restrain the foot or boot within said binding.

3. The binding of claim 2, wherein said first section includes a ratchet strap and said second section includes a foot or boot engagement strap.

4. The binding of claim 2, wherein both said first section and said second section are arranged for tool free disengagement from said first mounting location while said base is attached to said gliding implement.

5. The binding of claim 1, wherein said base and said at least one strap include complementary locking members for releasably engaging said at least one strap to said base at said first mounting location and said second mounting location.

6. The binding of claim 5, wherein said base includes a sidewall defining a slot and said complementary tool free locking members are contained completely within said sidewall slot.

7. The binding of claim 5, wherein said at least one strap is actuatable by a user to disengage, tool free, said complementary locking members at said first mounting location and said second mounting location.

8. The binding of claim 5, wherein said at least one strap is actuatable by a user towards said base to disengage said complementary locking members.

9. The binding of claim 1, wherein said binding has a heel to toe direction and wherein said first mounting location and said second mounting location extend in said heel to toe direction.

10. A binding for securing a foot or a boot to a gliding implement, comprising:

a base for receiving the foot or boot, said base being attachable to the gliding implement;

at least one strap that is conformable to a surface of the foot or boot as it is tightened thereagainst;

said at least one strap being attachable on said base at a first mounting location and at a second mounting location, said at least one strap being disengageable tool free from said first mounting location and movable to said second mounting location while said base is attached to the gliding implement, wherein said at least one strap cannot be removed from said base while said base is attached to said gliding implement; and a sidewall having a slot for receiving said at least one strap in said first mounting location and said second mounting location, said sidewall slot including a bearing surface against which a mounting end of said at least one strap is seatable.

11. The binding of claim 10, wherein said at least one strap includes at least one of a toe strap, an ankle strap and a shin strap.

12. The binding of claim 10, wherein each side of said base includes a sidewall having a toe strap slot and an ankle strap slot, said at least one strap including a toe strap having a first section and a second section each of which is attachable to said base within said respective toe strap slots in a first mounting location and a second mounting location, and also including an ankle strap having a first section and a second section each of which is attachable to said base within said respective ankle strap slots in a first mounting location and a second mounting location.

13. The binding of claim 12, wherein said first section of said toe strap and said ankle strap each includes a ratchet strap and said second section of said toe strap and said ankle strap each includes a boot engagement strap having a buckle that is releasably engageable with said ratchet strap.

14. The binding of claim 10, wherein said at least one strap includes a first section and a separate second section that are releasably engageable together, wherein one of both said first and second sections, and said base, includes a locking member, and the other of both said first and second sections, and said base, includes at least two complementary locking members corresponding to said first and second mounting locations, wherein said first and second sections are detachable, tool free, from said first mounting location, while said base is attached to the gliding implement.

15. The binding of claim 10, wherein said at least one strap includes a living hinge.

16. The binding of claim 15, wherein said living hinge includes an opening in a mounting end of said at least one strap.

17. The binding of claim 16, wherein said mounting end including said opening has an outer curved profile that seats against said base.

18. The binding of claim 15, wherein said at least one strap includes a lower end that is wider than an intermediate portion of said at least one strap.

19. The binding of claim 15, wherein said living hinge includes a mounting portion of said at least one strap having surface reliefs formed therein.

20. The binding of claim 19, wherein said surface reliefs include accordion type impressions in said strap surface.

21. The binding of claim 15, wherein said living hinge is positioned within said base.

22. The binding of claim 10, wherein said binding includes a heel to shin direction and said first mounting location and said second mounting location extend in said heel to shin direction.

23. A binding for securing a foot or a boot to a gliding implement, comprising:

a base for receiving the foot or boot, said base being attachable to a gliding implement;

at least one strap that is conformable to a surface of the foot or boot as it is tightened thereagainst;

said base and said at least one strap including complementary locking members for attaching said at least one strap to said base at a first mounting location, at least one of said at least one strap and a portion of said base being resiliently biased to urge said complementary locking members into engagement while said at least one strap is in an untightened state.

24. The binding of claim 23, wherein said at least one strap includes a mounting end having a living hinge that is seatable against one of said base and the gliding implement to urge the complementary locking members into engagement.

25. The binding of claim 24, wherein said base includes a slotwall having a bearing surface against which said mounting end is seated to urge said complementary locking members into engagement.

26. The binding of claim 24, wherein said base includes a slot having an open bottom exposing a bearing surface against which said mounting end is seatable.

27. The binding of claim 23, wherein said at least one strap includes a biasing member that seats against a support for said complementary locking members in said base.

28. The binding of claim 23, wherein a portion of said base, against which a mounting end of said at least one strap is seated, is resilient and urges said complementary locking members into engagement.

29. The binding of claim 23, wherein said complementary locking members include a first set of teeth carried by said at least one strap and a second set of teeth carried by said base.

30. The binding of claim 23, wherein said complementary locking members include a boot carried by said at least one strap and a set of teeth carried by said base.

31. The binding of claim 23, wherein said base includes a sidewall having a slot for receiving said at least one strap in said first mounting location and in a second mounting location, wherein said complementary locking members also engage said at least one strap to said base at said second mounting location, said complementary locking members being contained within said slot.

32. The binding of claim 23, wherein said at least one strap is actuatable by a user, tool free, to disengage said complementary locking members.

33. The binding of claim 23, wherein said complementary locking members include at least one boss carried by one said at least one strap and said base, and at least one catch carried by the other of said at least one strap and said base.

34. A snowboard binding for securing a boot to a snowboard, comprising:

a baseplate including an aperture and a complementary hold down disc for mating with the aperture and securing the baseplate to the snowboard, said baseplate including a pair of sidewalls and a heel hoop, and a highback extending from a rear portion of said baseplate;

at least one strap that is conformable to a surface of the boot as it is tightened thereagainst, said at least one strap including a mounting end portion; and at least one of said pair of sidewalls and said heel hoop defining a slot that includes a bottom that is open, the slot receiving said mounting end portion of said at least one strap such that said mounting end portion is seatable through said open bottom of said slot against the snowboard, the at least one strap being mountable to the baseplate within said slot in a first fixed mounting location and in a second fixed mounting location different from the first fixed mounting location, said mounting end portion of said at least one strap being releasable, tool free, from said first fixed mounting location while said baseplate is attached to said snowboard and then repositionable and remountable, tool free, in the second fixed mounting location, wherein said at least one strap cannot be removed from said slot while said baseplate is attached to said snowboard.

35. The snowboard binding of claim 34, wherein said mounting end portion of said at least one strap includes a living hinge.

36. The snowboard binding of claim 34, wherein said at least one strap includes a first locking member and said slot includes a second complementary locking member that is engageable with said first locking member to attach said at least one strap to said base in said first fixed mounting location.

37. The snowboard binding of claim 36, further including a biasing member that biases said first locking member and said second locking member in engagement.

38. The snowboard binding of claim 37, wherein said biasing member is a living hinge.

39. The snowboard binding of claim 36, wherein said at least one strap is actuatable by a user to disengage said first locking member and said second complementary locking member at said first mounting location.

40. The snowboard binding of claim 36, wherein said at least one strap is moveable by a user to disengage said first locking member and said second complementary locking member at said first mounting location.

41. The snowboard binding of claim 36, wherein said at least one strap is moveable towards said base to disengage said first locking member and said second complementary locking member at said first mounting location.

42. The snowboard binding of claim 36, wherein application of a force along an axis of said at least one strap disengages said first locking member and said second complementary locking member at said first mounting location.

43. The snowboard binding of claim 36, wherein said mounting end portion of said at least one strap is compressible to disengage said first locking member from said second locking member.

44. The snowboard binding of claim 36, wherein said first locking member is pivotable relative to said second locking member when said locking members are engaged.

45. The snowboard binding of claim 36, wherein a portion of an outer profile of said mounting end portion is rounded.

46. A method for adjusting tool free, the mounting location of a foot or boot engagement member on a binding while the binding is mounted to a gliding implement, the method comprising:

providing a binding having a base and at least one foot or boot engagement member, the binding including a first mounting location for the at least one foot or boot engagement member and a second mounting location for the at least one foot or boot engagement member, the binding being mounted to the gliding implement; and adjusting the at least one foot or boot engagement member from the first mounting location to the second mounting location without tools while the binding is mounted to the gliding implement by moving the at least one foot or boot engagement member relative to the base to disengage complementary locking members on the at least one foot or boot engagement member and the base, said first and second mounting locations being displaced from one another, wherein said at least one foot or boot engagement member cannot be removed from the binding while being adjusted from said first mounting location to said second mounting location.

47. A method for adjusting tool free, the mounting location of a foot or boot engagement member on a binding while the binding is mounted to a gliding implement, the method comprising:

providing a binding having a base and at least one foot or boot engagement member, the binding including a first mounting location for the at least one foot or boot engagement member and a second mounting location for the at least one foot or boot engagement member, the binding being mounted to the gliding implement; and adjusting the at least one foot or boot engagement member from the first mounting location to the second mounting location without tools while the binding is mounted to the gliding implement by compressing a resilient member to disengage the at least one foot or boot engagement member from the first mounting location, said first and second mounting locations being displaced from one another, wherein said at least one foot or boot engagement member cannot be removed from the binding while being adjusted from said first mounting location to said second mounting location.

48. The method of claim 47, wherein the step of compressing comprises:

moving the at least one foot or boot engagement member toward the gliding implement.

49. A snowboard binding comprising:

a base having a bottom and at least one side flange supported by the bottom, the at least one side flange having a front slot that extends from a top of the at least one side flange toward the bottom of the at least one side flange, and a rear slot that extends from a top of the side flange toward a bottom of the side flange;

a toe strap positioned at least partially within the front slot;

at least two front strap mounting features adapted to attach the toe strap to the base at at least two displaced mounting positions, the at least two front strap mounting features positioned within the front slot and adapted to allow the toe strap to be moved between the at least two mounting positions without tools while the base is attached to a snowboard, wherein the toe strap cannot be removed from the base while being moved between the at least two mounting positions;

an ankle strap positioned at least partially within the rear slot; and at least two rear strap mounting features positioned within the rear slot adapted to engage the ankle strap at at least two rear mounting positions, the at least two rear strap mounting features adapted to allow the ankle strap to be moved between the at least two rear mounting positions without tools while the base is attached to a snowboard.

50. The snowboard binding of claim 49, wherein the toe strap has an end positioned within the front slot, the end having a rounded shape.

51. The snowboard binding of claim 49, wherein the end of the toe strap has an opening formed through the toe strap.

52. The snowboard binding of claim 49, wherein the rear slot extends from the top of the side flange partially toward the bottom of the side flange and the bottom of the side flange below the rear slot is positioned substantially away from the snowboard when the binding is mounted to the snowboard.

53. The snowboard binding of claim 52, wherein the front and rear strap mounting features are recesses formed in respective sidewalls of the front and rear slots.

54. A snowboard binding comprising:

a base, including a bottom, a side flange supported by the bottom, and a slot that extends from a top of the side flange only partially through the side flange such that the slot does not extend through a bottom of the side flange;

at least one binding strap; and a detent, supported by the base and formed in the side flange, adapted to mount the at least one binding strap to the base in at least two mounting positions, the detent and the at least one binding strap being configured to allow the at least one binding strap to be selectively moved between the at least two strap mounting positions without tools and without separating the at least one binding strap from the base while the base is attached to a snowboard.

55. The binding of claim 54, wherein the slot has opposite sidewalls, at least one of the sidewalls including at least two strap mounting features, and wherein the at least two strap mounting features are adapted to engage with the at least one strap to prevent the strap from being withdrawn upwardly from the slot.

56. The binding of claim 55, wherein the side flange has an outer side including a window formed therein that exposes the slot.

57. The binding of claim 56, further including a cover that covers the window.

58. The binding of claim 55, wherein the detent includes at least two recesses formed at sidewalls within the slot.

59. The binding of claim 54, wherein the at least one binding strap includes a resilient end adapted to deform to allow the at least one strap to be disengaged from a first strap mounting position and moved to a second strap mounting position.

60. The binding of claim 59, wherein the strap is formed of at least two materials including a first material that forms a body of the strap and a resilient material that forms a resilient end of the strap.

61. The binding of claim 59, wherein the resilient end of the strap has at least one aperture to form the resilient end.

62. The binding of claim 54, wherein the detent includes a resilient shelf adapted to be deformed to allow the at least one binding strap to be selectively moved between the at least two strap mounting positions.

63. The binding of claim 62, wherein:

the detent includes a slot that extends from a top of the side flange toward a bottom of the side flange, and the resilient shelf is positioned near a bottom of the slot.

64. The binding of claim 54, wherein the at least one binding strap is a heel strap.

65. The binding of claim 54, wherein the detent comprises:

means for allowing the at least one binding strap to be selectively moved between the at least two strap mounting positions without tools while the base is attached to a snowboard.

66. The binding of claim 54, wherein the base includes a slot, wherein the detent includes recesses formed in the slot and adapted to engage with an end of the at least one strap, and wherein the at least one strap includes a tab adapted to engage with the recesses.

67. A gliding apparatus comprising:

a snowboard; and the snowboard binding of claim 54 attached to the snowboard.

68. The binding of claim 54, wherein the detent includes a resilient member.

69. A snowboard binding comprising:

a base having at least two mounting positions;

at least one binding strap constructed and arranged to attach to the base at the at least two mounting positions; and at least one resilient member adapted to deform to allow the at least one binding strap to be moved, tool free, between the at least two mounting positions on the base, the resilient member biasing the at least one binding strap towards engagement at one of said mounting locations when the at least one binding strap is in an untensioned state.

70. The binding of claim 69, wherein the base includes a side flange and the side flange includes a slot that extends from a top of the side flange toward a bottom of the side flange.

71. The binding of claim 70, wherein the slot has opposite sidewall, at least one of the sidewalls including at least two strap mounting features adapted to engage with the at least one binding strap to prevent the binding strap from being withdrawn upwardly from the slot.

72. The binding of claim 70, wherein the side flange has an outer side including a window formed therein that exposes the slot.

73. The binding of claim 69, wherein the resilient member is fixed to the at least one binding strap.

74. The binding of claim 69, wherein the at least one binding strap is a heel strap.

75. The binding of claim 69, wherein the resilient member is a resilient shelf.

* * * * *